United States Patent [19]

Geiger

[11] 4,275,783

[45] Jun. 30, 1981

[54] MOLDING MACHINE FOR FABRICATING BOXLESS MOLDS

[75] Inventor: Werner Geiger, Meggen, Switzerland

[73] Assignee: Inventio AG, Hergiswil, Switzerland

[21] Appl. No.: 71,945

[22] Filed: Sep. 4, 1979

[30] Foreign Application Priority Data

Sep. 5, 1978 [CH] Switzerland ..... 9318/78

[51] Int. Cl.[3] ..... B22C 11/04; B22C 17/08

[52] U.S. Cl. ..... 164/146; 164/168; 164/181

[58] Field of Search ..... 164/168, 180, 181, 192, 164/193, 194, 187, 146

[56] References Cited

U.S. PATENT DOCUMENTS 3,630,268 12/1971 Hatch ..... 164/181

4,114,677 9/1978 Wernli ..... 164/168

FOREIGN PATENT DOCUMENTS 520080 3/1955 Italy ..... 164/210

*Primary Examiner*—Robert D. Baldwin

*Attorney, Agent, or Firm*—Werner W. Kleeman

[57] ABSTRACT

A molding machine for fabricating boxless molds wherein the mold boxes or flasks for the mold halves are moved, upon arms of a turnstile or rotatable cross-shaped element, cyclically to various molding stations of the molding machine. Fabrication of a casting mold at the closing or assembly station is rendered possible in that, a support plate of a conveyor device for the further transport of the casting molds is structured as part of the closing or assembly station. An ejector punch, a support means for the mold boxes or flasks and an elevationally displaceable table are arranged such that a mold lower part and a mold upper part are successively ejected into the support plate for the purpose of forming the casting mold.

6 Claims, 7 Drawing Figures

MOLDING MACHINE FOR FABRICATING BOXLESS MOLDS

BACKGROUND OF THE INVENTION

The present invention relates to a new and improved construction of molding machine for the fabrication of boxless casting molds.

In German patent publication No. 2,638,103 there is taught to the art a molding machine of the previously mentioned type, wherein a turnstile carries at four pivot arms a respective mold box or flask for accommodating a mold half. The pivot arms which support the mold boxes or flasks are vertically displaceable and rotatable through an angle of 180° and by means of a turnstile drive these pivot arms are cyclically pivoted to successive mold stations. At a first station, coacting with an exchangeable pattern or match plate support, there is formed, by filling sand and compaction, alternately a mold lower part and a mold upper part. Following rotation of the pivot arm through 180°, during the next cycle the mold half is transferred by the pivot arm to the second mold station and during the next following cycle it is transferred to the third station. Both the second and third stations serve as core insert stations. Now if during the next cycle a mold lower part arrives at the fourth mold station, structured as a closing or assembly station, then the mold lower part must be brought into alignment with a mold upper part in order to complete the fabrication of the final casting mold.

To render this possible both of the pivot arms of the turnstile, carrying a mold box or flask for the mold upper part, are additionally individually pivotable about 90° forwardly and backwardly within the turnstile. Now as soon as a mold lower part has arrived at the mold closing station, then the pivot arm carrying the mold upper part of the third station, with the turnstile stationary, is forwardly rocked or pivoted through 90° so that both mold halves, following the rotation of the mold upper part through 180°, are brought into superimposed alignment with one another. So that the cyclic operation is not disturbed, it is necessary, following the ejection of the finished mold, to again rock back through 90° the aforementioned pivot arm. The finished casting mold is then tranferred, by means of a transfer device, to a conveyor device.

The heretofore known molding machines are associated with a number of decisive drawbacks. The relative pivotability of both rather massive pivot arms, carrying a mold upper part, with respect to the turnstile requires two additional powerful drives. This, in turn, increases the susceptibility of the equipment to breakdown and also appreciably raises the costs thereof. Therefore, it is quite questionable whether such prior art molding machine will find acceptance in practice. Moreover, the transfer of the casting mold from the closing station to the conveyor device requires additional space.

SUMMARY OF THE INVENTION

Therefore, with the foregoing in mind it is a primary object of the present invention to provide a new and improved construction of molding machine which is not associated with the aforementioned drawbacks and limitations of the prior art proposals.

Another and more specific object of the present invention aims at the provision of a new and improved construction of molding machine which overcomes the previously explained drawbacks and affords a constructionally simple, compact molding machine which reliably works, during continuous operation, without the need for expensive auxiliary devices.

Now in order to implement these and still further objects of the invention, which will become more readily apparent as the description proceeds, the molding machine for the fabrication of boxless casting molds, as comtemplated by the invention, comprises a pivot device which is cyclically rotatable about a substantially vertical axis. This pivot device comprises at least three pivot arms each provided with a mold box or flask for receiving a respective mold half, the mold boxes being rotatable about a horizontal axis and arranged to be vertically displaceable. A sand filling and compaction station coacts with an exchangeable pattern or match plate support. There is also provided at least one core insert station and a closing or assembly station where two mold halves, forming a casting mold, can be brought into superimposed alignment. A conveyor device serves to outfeed the completed casting molds. Importantly, a transport device of the conveyor device is structured as part of the closing or assembly station.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
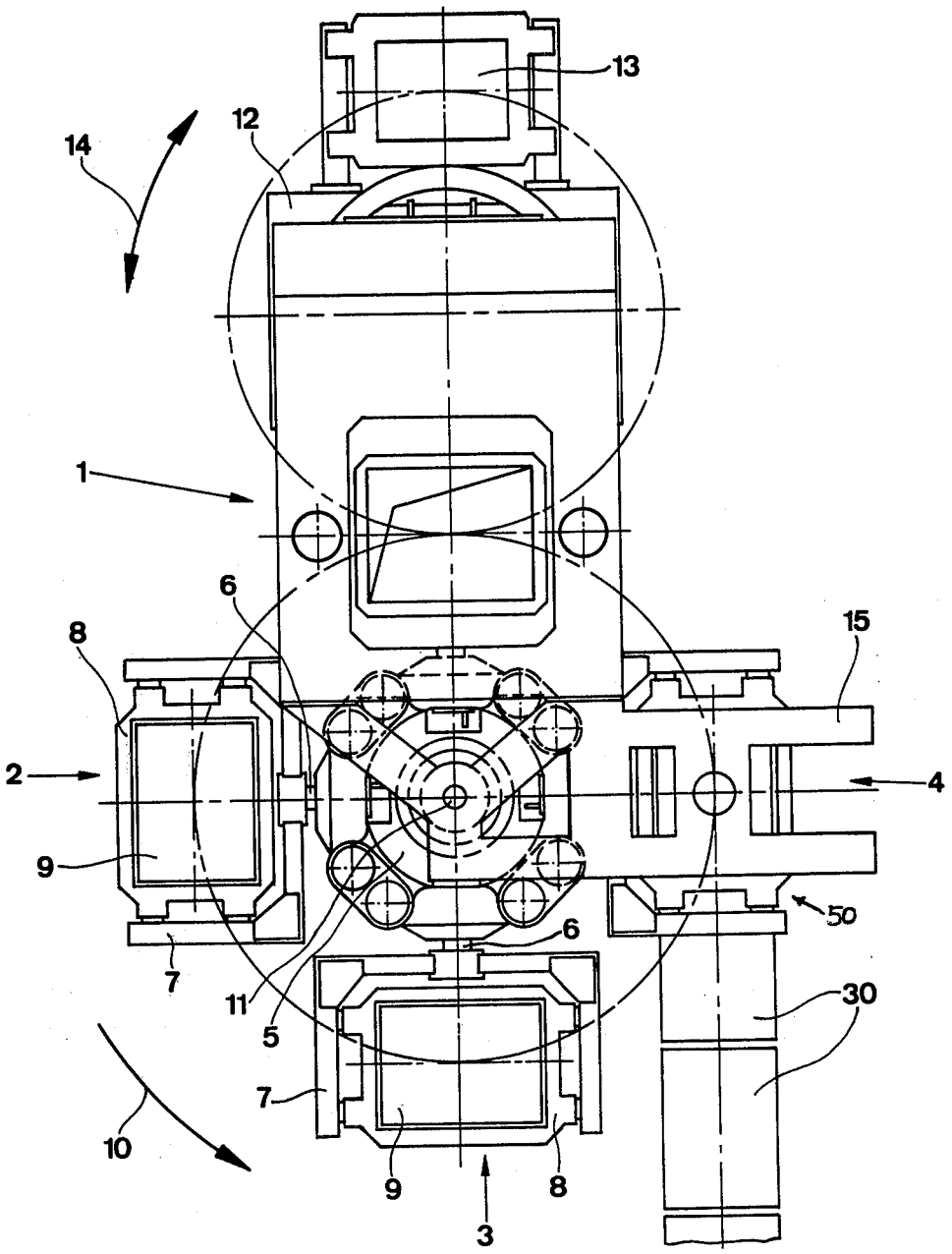
FIG. 1 is a top plan view of a molding machine constructed according to the invention.

Describing now the drawings, it is to be understood that for purposes of simplification of the drawings only enough of the construction of the molding machine has been shown as deals directly with the invention and as needed for understanding the underlying principles and concepts thereof. Turning attention now to FIG. 1, it is to be observed that reference character 1 designates a sand filling and compaction station, reference characters 2 and 3 designate two core insert stations, and reference character 4 designates a mold closing or assembly station of the molding machine. A pivot device 5, constructed as a suitable rotatable or indexable unit, will be seen to comprise four pivot arms 6 offset from one another through an angle of 90° and forming a turnstile or equivalent structure. At each pivot arm 6 there is secured a mold box holder or support device 7 carrying a mold box or flask 8 for a mold half 9. The pivot device 5 is cyclically indexed or pivoted by any suitable and therefore not particularly illustrated pivot or index drive, forwardly through 90° in the direction of the arrow 10 and rotates horizontally about an essentially vertical axis 11. Hence, the mold boxes or flasks 8 are successively transported or indexed to the individual mold stations 1, 2, 3 and 4. The mold boxes or flasks 8 are individually horizontally rotatable through 180° and vertically displaceable by conventional devices, well known in the molding machine art, which coact with the pivot arms 6, and therefore need not here be further discussed.

A pivotable pattern or match plate support 12 carries two pattern or match plates 13 arranged opposite one another, wherein one of such match plates serves as the match plate for a mold lower part and the other as the match plate for a mold upper part. By to-and-fro rocking through 180°, in the direction of the arrow 14, it is possible to alternately transfer the match plates 13 to the sand filling and compaction station 1, so that at that location there are alternately produced a mold lower part—also referred to as a lower mold half—and a mold upper part—also referred to as an upper mold half. Belonging to the closing or assembly station 4 is a transport device or unit 22 of a conveyor device, generally indicated by reference character 50, serving for the outfeed of the finished casting molds 30, as will be explained more fully hereinafter.

Figure 2:
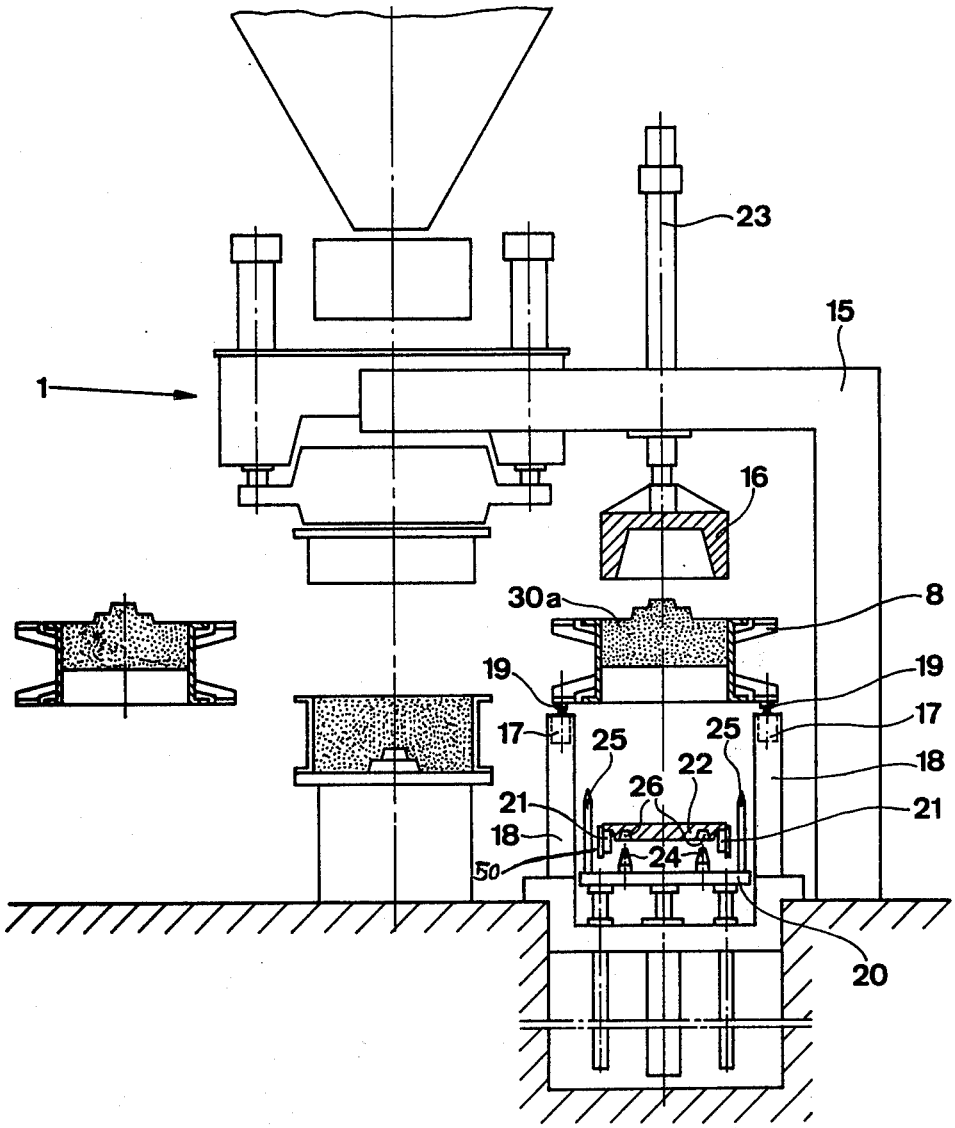
FIG. 2 is a partially sectional side view through the closing or assembly station of the molding machine shown in FIG. 1.

A support structure 15 of the closing or assembly station 4, illustrated in FIG. 2, will be seen to comprise a fluid operated, here shown as a hydraulic elevationally displaceable, i.e., up and down movable ejection punch 16 or equivalent structure which serves to eject the mold halves. Three columns 18, of which only two are visible in the showing of the drawing, each are provided with a respective hydraulic plunger 17 or equivalent structure forming together with the support heads 19 a floating mounting or support arrangement for the mold boxes or flasks 8 attached at the related pivot arm 6. A fluid-operated, here shown as a hydraulic elevationally displaceable table 20 is mounted below a support plate 22 which bears upon rolls 21. The support plate 22, constituting the transport device or unit, and the rolls 21 are parts of the aforementioned conveyor device 50 constructed as a floor mounted conveyor designed such that the support plate 22, between two conveying steps, can be positioned as part of the closing or assembly station 4 always at the same location. The ejection or ejector punch 16, the mold flasks or boxes 8, the floating support arrangement 17, 19 for the mold boxes 8, the support plate 22 and the table 20 are all arranged centrally symmetrical with respect to the vertical central axis 23 of the closing station 4.

Figure 7:
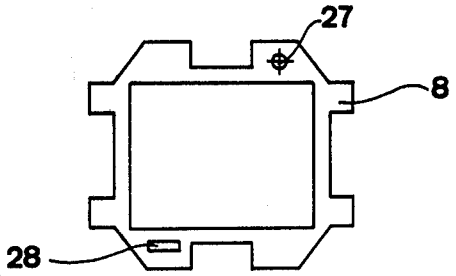
FIG. 7 is a detail showing of a mold box or flask.

At the table 20 there are attached two short, substantially conical guide pins 24 and two long guide pins 25 having conical tips. During raising of the table 20 the conical guide pins 24 initially engage with appropriate recesses or holes 26 or the like of the support plate 22, and thereafter, the guide pins 25 engage into appropriate openings 27 and 28 of the mold flask 8, with the result that the plate 22 and the mold box 8 are centered. Instead of using the short guide pins 24 it would be possible to also arrange at the table 20 a magnetic plate for centering the support plate 22 which is composed of a magnetic material. Hence, conceptually the elements 24 also can be considered to constitute a magnetic centering and holding plate. According to an advantageous construction a respective pin of the guide pin pairs 24 and 25 has a substantially circular-shaped cross-sectional configuration and the other pin an approximately rectangular cross-sectional configuration. The recesses or holes 26 of the support plate 22 and the openings or apertures 27 and 28 of the mold box 8 then will have appropriate cross-sectional configurations, as such has been shown by way of example in FIG. 7 for the mold flask or box 8. In this way it is possible to additionally secure against rotation the mold boxes 8 and support plate 22.

Figure 3:
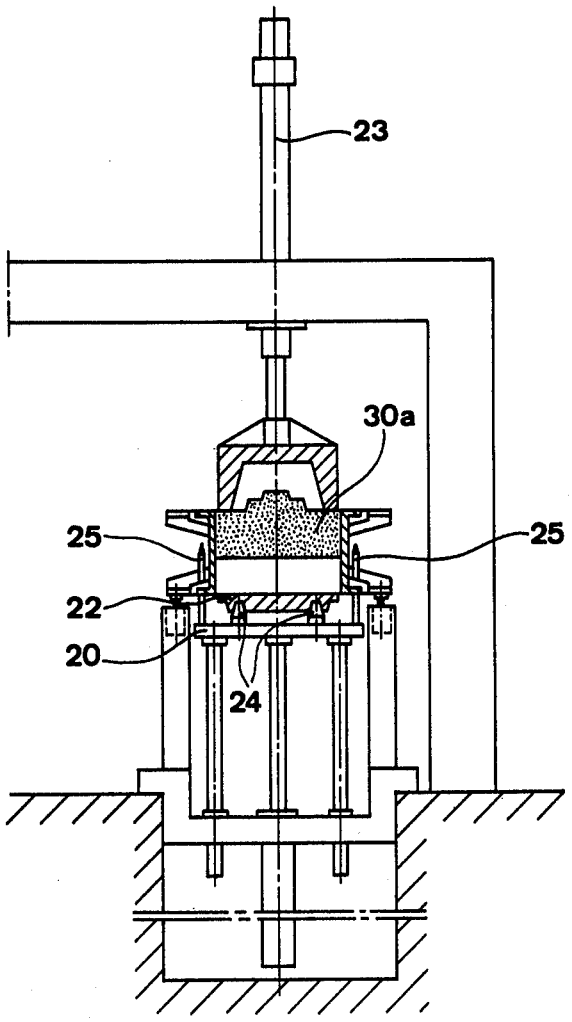
FIGS. 3 to 6 respectively show the right-hand half of the arrangement of FIG. 2, depicting different work positions at the closing or assembly station.

Having now had the benefit of the foregoing discussion of the description of the molding machine of the invention its operation will now be considered and is as follows:

Always after rest intervals of the same duration the pivot device 5 rocks or pivots the pivot arms 6 together with the mold boxes or flasks 8 attached thereat through 90° cyclically in the direction of the arrow 10, so that the same amount of time is available for all of the different work procedures or operations performed at each mold station 1, 2, 3 and 4. At the sand filling and compaction station 1 there is alternately fabricated a mold lower part and a mold upper part, in that the match plate exchange operation of the match plate support 12 is accomplished at the same cycle as the pivoting or rocking of the pivot device 5. After producing a mold half the pivot device 5, during the next cycle, is rotated through 90°, so that the mold half, following a simultaneous horizontal rotation about 180°, arrives at the core insert station 2. During the following cycle the mold half is rocked through a further 90° into the core insert station 3. During the next cycle of the indexable pivot device 5 the mold half, constituting a mold lower part 30*a*, arrives at the closing or assembly station 4, with its center point coinciding with the central axis 23. By lowering the pivot arm 6 the mold box 8 together with the mold lower part 30*a* is deposited onto the support heads 19 and floatingly supported (FIG. 2). Now the table 20 is raised, so that the guide pins 24 engage with the recesses 26 of the support plate 22 and lift the latter from the rolls 21 of the floor mounted track of the conveyor device 50. During further lifting of the table 20, until contacting the mold box 8, the guide pins 25 are displaced into the openings 27 and 28, with the result that the mold 8 is effectively centered with respect to the central axis 23 (FIG. 3).

Thereafter, the ejection punch 16 is lowered onto the mold lower part 30*a* and since the ejection punch 16 exerts a larger downward force than the table 20 exerts an upward force, the mold lower part 30*a* is ejected out of the mold box or flask 8. The mold lower part 30*a* then comes to rest upon the support plate 22 and together with the support plate 22 is further lowered by the table 20 until reaching the position shown in FIG. 4. In this position the guide pins 25 again release the mold box 8, whereas the guide pins 24 continue to position the support plate 22. After ejection of the mold lower part 30*a* the ejection or ejector punch 16 is again raised, whereupon there is accomplished the next rotational or indexing cycle through 90°.

Figure 4:
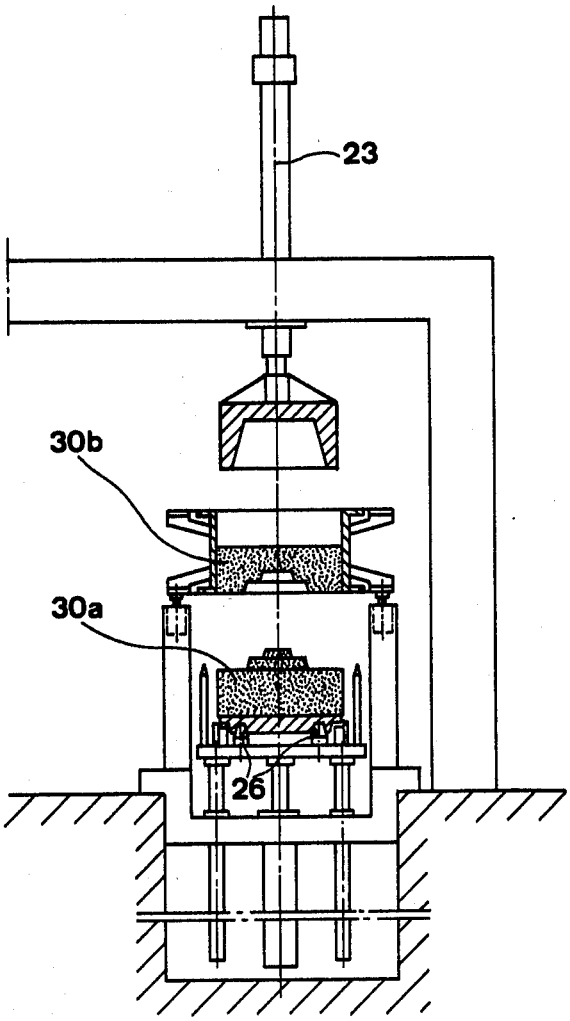
Figure 5:
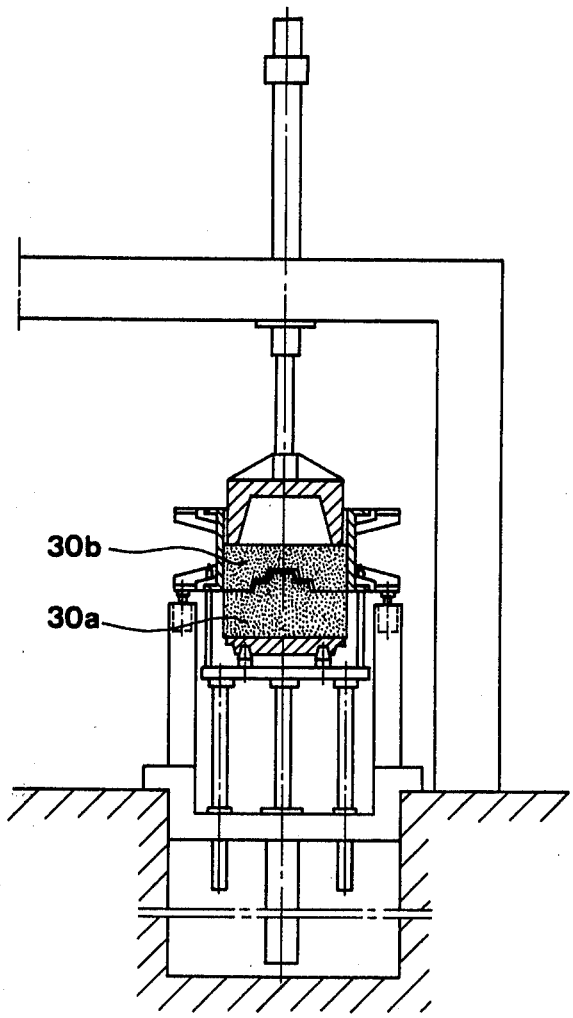
Figure 6:
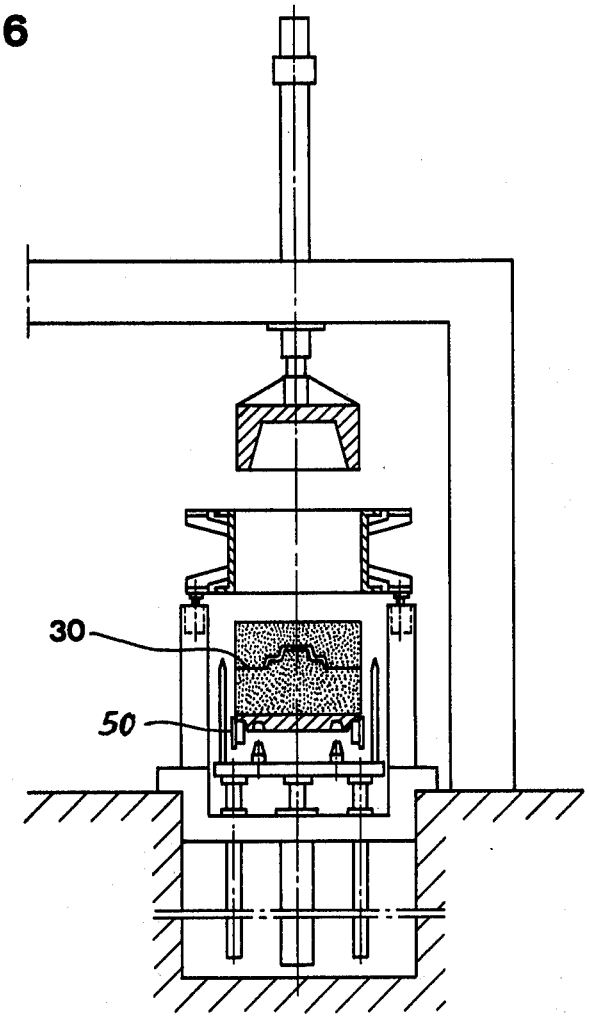

During this cycle the empty mold box 8 arrives at the sand filling and compaction station, where there is formed a new mold lower part, whereas the mold upper part 30*b* arrives with the next mold box or flask 8, while carrying out a horizontal rotation through 180°, from the core insert station 3 at the mold closing or assembly station 4 and is deposited upon the support heads 19 or equivalent structure (FIG. 4). Thereafter, the table 20 together with the mold lower part 30*a* reposing upon the support plate 22 are raised, and the mold box 8 is centered by the guide pins 25 before the mold lower part 30*a* comes into contact with the mold upper part 30*b* (FIG. 5). Now the ejection punch 16 is lowered and the mold upper part 30*b*, while lowering the table 20, is ejected onto the mold lower part 30*a*. Following the just explained ejection operation the ejection punch 16 is again raised and by further lowering the table 20 into the rest position the support plate 22 with the now finished casting mold 30 rests upon the rolls 21 of the conveyor device 50 (FIG. 6), whereafter the next indexing rotational cycle of the pivot device 5 can be accomplished. The support plate 22 together with the completed casting mold 30 is now conveyed by the conventional conveying means at the floor mounted track through a horizontal conveying step further in the direction of the foundry, and at the same time an empty support plate 22 is shoved into the position of the closing station 4 which is defined by the central axis 23 thereof.

During each two respective cycles of the pivot device 5 there repeat the described operations, all of which can be coordinatively controlled relative to one another in time by means of any suitable control device, so that the casting molds can be automatically fabricated. By virtue of the centering of the mold boxes or flasks with respect to the axis of the closing station, during the ejection of the mold upper part and the mold lower part and the transport device prior to start of the first ejection operation until the end of the second ejection operation, it is possible to obtain casting molds having exactly fitting mold halves. Moreover, due to the floating support arrangement of the mold boxes there is beneficially obtained a gentle ejection of the mold halves out of the stable horizontally supported mold boxes.

While there are shown and described present preferred embodiments of the invention, it is to be distinctly understood that the invention is not limited thereto, but may be otherwise variously embodied and practiced within the scope of the following claims. Accordingly,

What I claim is:

1. A molding machine for fabricating boxless molds, comprising:

a number of mold stations defining a sand filling and compaction station coacting with an exchangeable match plate support, at least one core insert station and a mold closing station where two mold halves, forming a casting mold, are brought into superimposed alignment with one another;

a pivot device cyclically rotatable about a vertical axis for movement past said number of mold stations;

said pivot device being provided with at least three pivot arms each having a respective mold box for receiving a mold half, each mold box being rotatable about a substantially horizontal axis and vertically displaceable;

a conveyor device for transporting the molds; and said conveyor device comprising a transport device structured as part of said closing station;

said closing station comprising:

a vertically centrally symmetrical arrangement, viewed from the top towards the bottom, of an elevationally displaceable mold half-ejection punch;

a support arrangement including stationary support column means for a mold box lowered thereon by the pivot arm during a mold closing cycle at the closing station;

said support arrangement including fluid operated elements coacting with said support column means for supporting said mold box lowered onto said support column means;

said transport device comprising a support plate for receiving two mold halves forming a fabricated mold; and an elevationally displaceable table for raising and lowering the support plate.

2. The molding machine as defined in claim 1, wherein:

said support arrangement for said mold boxes is floatingly structured by means of said fluid operated elements which contain hydraulic plunger means.

3. The molding machine as defined in claim 1, wherein:

said table is movable from a rest position into an elevationally displaced position;

said support plate having centering receiving means;

said table being provided with first centering means and second centering means;

said first centering means engaging with said centering receiving means of said support plate upon raising of the table out of its rest position;

each mold box located at the closing station being provided with centering receiving means; and said second centering means, during further raising of said table, engaging with said centering receiving means of said mold box at the closing station.

4. The molding machine as defined in claim 3, wherein:

said first centering means comprise at least two relatively short, substantially conical guide pins;

said centering receiving means of the support plate comprising recesses for receiving said two guide pins;

said second centering means comprising two longer guide pins having conical tips; and said centering receiving means of the mold box located at the closing station being provided with openings for receiving said two longer guide pins.

5. The molding machine as defined in claim 3, wherein:

said first centering means comprises magnetic plate means.

6. The molding machine as defined in claim 4, wherein:

one of the shorter guide pins and one of the longer guide pins has a substantially circular-shaped cross-sectional configuration, whereas the other respective guide pin of the shorter and longer guide pins has an approximately rectangular cross-sectional configuration.

* * * * *